US007954553B2

(12) United States Patent
Johnson et al.

(10) Patent No.: US 7,954,553 B2
(45) Date of Patent: Jun. 7, 2011

(54) USE OF LOW IMPACT EXPANSION TO REDUCE FLOW FRICTION

(75) Inventors: Michael H. Johnson, Katy, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 12/134,474

(22) Filed: Jun. 6, 2008

(65) Prior Publication Data

US 2009/0139725 A1 Jun. 4, 2009

Related U.S. Application Data

(60) Provisional application No. 60/933,467, filed on Jun. 6, 2007.

(51) Int. Cl.
*E21B 29/10* (2006.01)
*E21B 37/02* (2006.01)

(52) U.S. Cl. ..... 166/381; 166/369; 166/277; 166/207

(58) Field of Classification Search ..... 166/369, 166/277, 297, 381, 207
See application file for complete search history.

(56) References Cited

U.S. PATENT DOCUMENTS

| | | | | |
|---|---|---|---|---|
| 4,299,282 | A * | 11/1981 | Thornton | 166/177.3 |
| 6,523,615 | B2 | 2/2003 | Gandy et al. | 166/381 |
| 2001/0027867 | A1 * | 10/2001 | Gandy et al. | 166/369 |
| 2004/0256112 | A1 * | 12/2004 | Harrall et al. | 166/380 |

OTHER PUBLICATIONS

Christen et al., "Technological Advances in Completion Pipe Design," IADC/SPE 87200, Mar. 2004, 14 pages.

* cited by examiner

*Primary Examiner* — William P Neuder
*Assistant Examiner* — Brad Harcourt
(74) *Attorney, Agent, or Firm* — Shawn Hunter

(57) ABSTRACT

Systems and methods for increasing fluid flow characteristics within a hydrocarbon production tubing string within a wellbore. An expansion member is passed through the interior flowbore of one or more production tubing string members. The expansion member smoothes the interior surface of the flowbore and may radially expand the interior surface of the flowbore.

6 Claims, 2 Drawing Sheets

USE OF LOW IMPACT EXPANSION TO REDUCE FLOW FRICTION

CROSS-REFERENCE TO RELATED APPLICATIONS

This application claims the priority of U.S. Provisional Patent Application Ser. No. 60/933,467 filed Jun. 6, 2007.

BACKGROUND OF INVENTION

1. Field of the Invention

The invention provides devices and methods for improving rates of hydrocarbon recovery from production wells. In particular aspects, the invention relates to the improvement of fluid flow characteristics along production tubulars.

2. Description of the Related Art

Hydrocarbon production fluid is produced though production tubing within a wellbore. Most typically, the production tubing is formed of a plurality of production tubing segments that are secured to one another by threading in an end-to-end manner to form a continuous string. The string is then cemented into the wellbore. A number of factors contribute to the efficiency with which fluid can be produced through production tubing. Among these factors is the amount of fluid flow friction that is created as the production fluid passes through the production tubing and the amount of flow area that is available within the production tubing.

Coated tubing has been used in the past to minimize this roughness factor, but such coatings are expensive and have been problematic in the past. U.S. Pat. No. 6,523,615 issued to Gandy et al. describes a technique for reducing corrosion, clogging and fluid flow friction within wellbore tubulars by subjecting the inside diameter surfaces to an electropolishing treatment prior to assembly and installation into the well bore.

SUMMARY OF THE INVENTION

The present invention provides devices and methods for improving production flow from a wellbore via production tubing. In a preferred embodiment, an expansion member, such as a swage, is passed through the flowbore of one or more production members to be assembled into a production string. The devices and methods of the present invention are applicable to standard production tubing string sections, which are assembled into a continuous production string, as well as to coiled tubing or other tubular members. In preferred embodiments, the expansion member physically smoothes the interior surface of the flowbore and slightly enlarges the flow area provided by the flowbore. In preferred embodiments, the interior diameter of the flowbore is increased within a range that is from about 0.25% to about 4%. In a particularly preferred embodiment, the amount of expansion of the flowbore diameter is about 1%. Thereafter, the production string is disposed into the wellbore, and production fluid is produced.

DETAILED DESCRIPTION OF THE PREFERRED EMBODIMENTS

Figure 1:
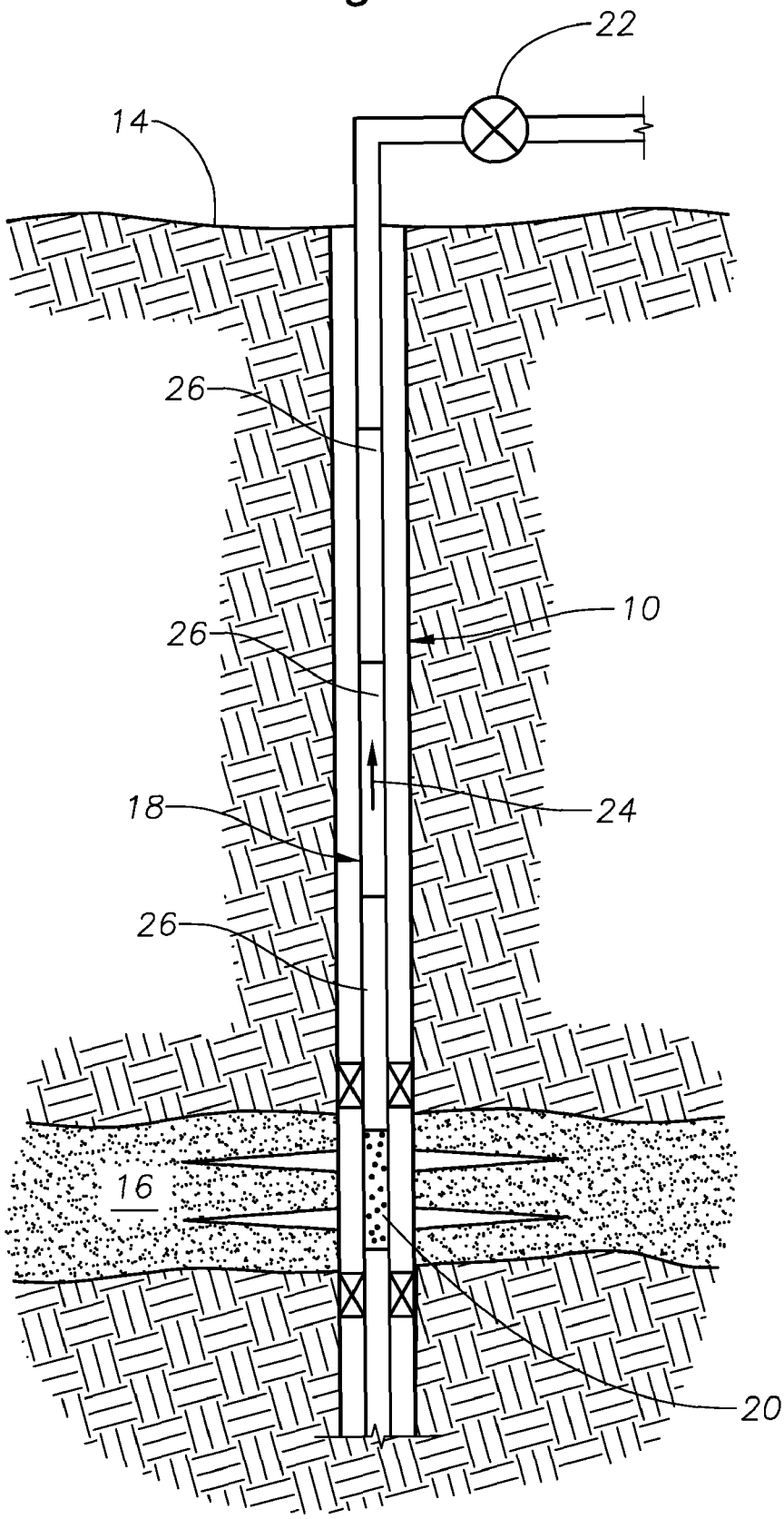
FIG. 1 is a side, cross-sectional view of an exemplary production wellbore which includes production tubing that is being internally refinished in accordance with the present invention.
Figure 2:
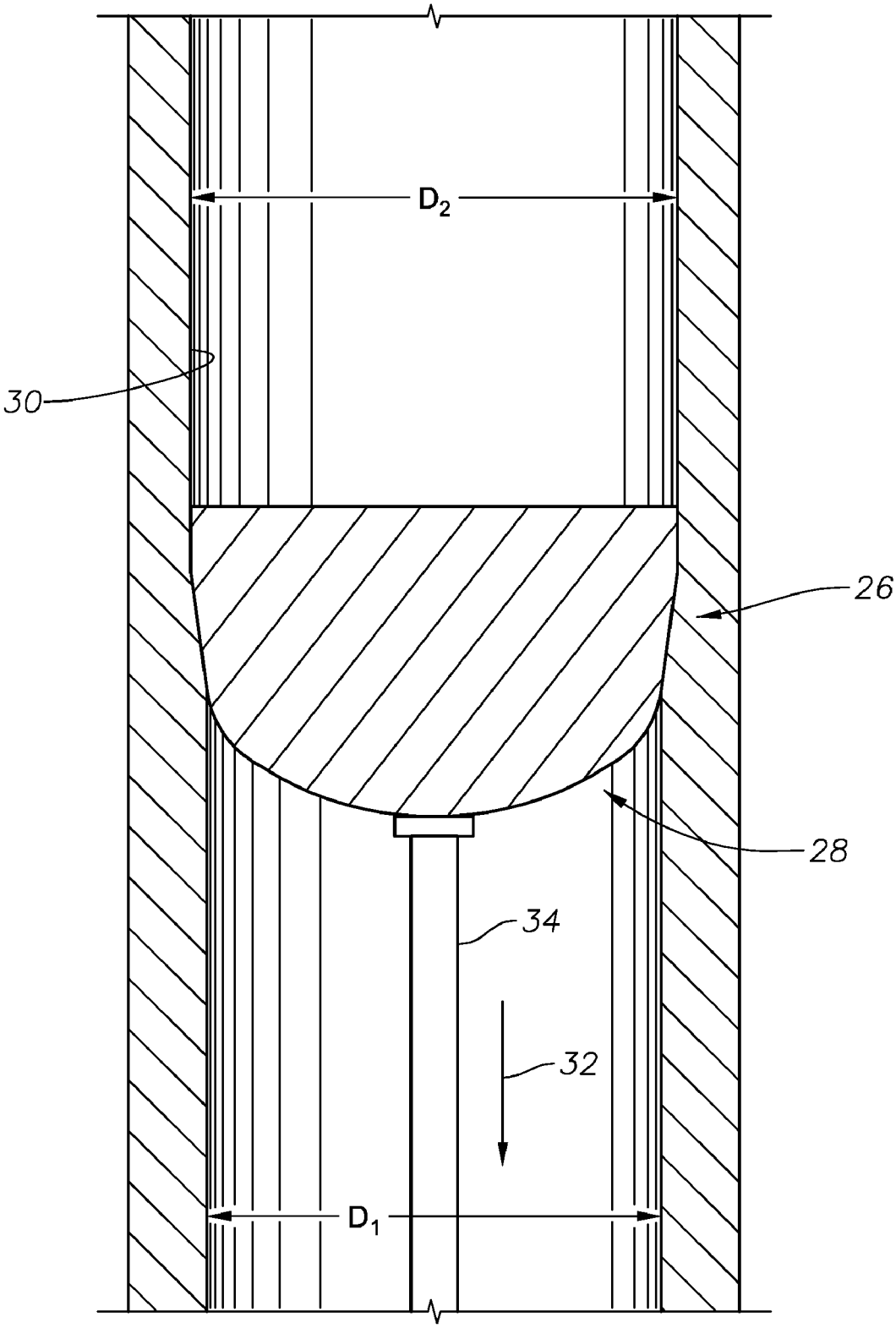
FIG. 2 is an illustration of a section of wellbore tubing having a swage passed through its interior flowbore.

FIG. 1 illustrates an exemplary hydrocarbon production wellbore 10 that has been drilled through the earth 12 from the surface 14 and through a hydrocarbon producing formation 16. The wellbore 10 includes a production tubing string 18 that extends from the surface 14 to a production nipple 20 that is located proximate the formation 16. The upper portion of the production tubing string 18 is operably associated with a valve 22 and other surface-based production equipment (not shown) of a type known in the art for the production of hydrocarbon fluid from the production tubing string 18. During production operations, hydrocarbon fluid enters the production tubing string 18 from the formation 16 and flows up the production tubing string 18 in the direction of the arrow 24 for recovery. It is noted that the production tubing string 18 is made up of a number of individual production tubing members 26 that are secured to one another in an end-to-end relationship, in a manner known in the art. The inventors have recognized that surface roughness within standard production tubing members 26 creates significant friction losses during production which results in reduced production performance. It is also noted that the systems and methods of the present invention have applicability to gas production wells as well as oil-producing wells.

In accordance with the present invention, an expansion cone or swage 28 is run through the flowbore 30 of each of the production tubing members 26 prior to interconnecting them and disposing them into the wellbore 10. The swage 28 moves through the flowbore 30 in the direction of arrow 32 under the impetus of cable 34 or by another means known in the art. As the swage 28 moves through the flowbore 30, it contacts and expands the interior surface of the flowbore 30 in a low impact manner (i.e., less than 4% expansion). As illustrated, the diameter of the flowbore 30 is increased from a first diameter D1 to a second diameter D2. It is presently preferred to provide an expansion within the range of from about 0.25% to about 4% as this amount of expansion yields a suitably smooth surface. In a particularly preferred embodiment, an expansion of 1% is achieved. The exterior surfaces of the production tubing members 26 are typically not measurably enlarged.

Testing has indicated that increased wall smoothness from the swaging technique described above results in improved fluid flow characteristics within production tubing. For example, improved fluid flow through production tubing member has been measured by a reduction in pressure drop across the tubing member. Tubing pressure drop (DP) decreases even as gas rate production increases, which emphasizes the benefit of lower pipe roughness. The results of one conducted test illustrated a numeric decrease in surface roughness. The surface roughness of a tubular specimen prior to a 0.75% expansion was 53 micro inches (internal peak to valley roughness). Following swaging, the surface roughness was measured to be 31 micro inches. The table below illustrates the expected daily gas production rate for changes in tubing roughness:

1. Gas production rate in all cases was 80.0 mmsck/d
2. Reservoir drawdown in all cases was 191 psi
3. Nominal tubing ID (interior diameter)=3.958 in.
4. Reduced (TubeCoat) tubing ID=3.918 in.

| Material | Roughness Selected | | | |
|---|---|---|---|---|
| | 4140 | TubeCoat (reduced ID) | TubeCoat (nominal ID) | Zero Roughness |
| Roughness (in) | 0.00060 | 0.0000523 | 0.0000523 | 0.0 |
| Wellhead Pressure (psi) | 1,345 | 1,740 | 1,789 | 1,873 |
| Tubing Pressure Drop (psi) | 1,522 | 1,126 | 1,078 | 994 |
| Pressure Drop Reduction (%) | 0.0 | 26.0 | 29.2 | 34.7 |

Comparison of tubing pressure drop, as shown in the Table below, may be a more relevant indicator than % reduction in DP because each case is producing at a different gas rate:

1. Wellhead pressure in all cases was 800 psi.
2. The nominal case is at 88.0 mmscf/d
3. Nominal tubing ID (interior diameter)=3.958 in.
4. Reduced (TubeCoat) tubing ID=3.918 in.

| Material | Roughness Selected | | | |
|---|---|---|---|---|
| | Nominal Tubing | TubeCoat (reduced ID) | TubeCoat (nominal ID) | Zero Roughness |
| Roughness (in) | 0.00060 | 0.0000523 | 0.0000523 | 0.0 |
| Daily Gas Production rate (mmscf/d) | 88.0 | 100.6 | 102.7 | 110.4 |
| Tubing Pressure Drop (psi) | 2,025 | 1,950 | 1,936 | 1,882 |
| Reservoir Drawdown (psi) | 233 | 308 | 322 | 376 |

While an exemplary swaging operation in accordance with the present invention has been described above with respect to individual production string members which are assembled into a continuous production string, it should be understood that it might also be applied to substantially continuous coiled tubing strings or to other tubulars.

Those of skill in the art will recognize that numerous modifications and changes may be made to the exemplary designs and embodiments described herein and that the invention is limited only by the claims that follow and any equivalents thereof.

What is claimed is:

1. A method of increasing fluid flow characteristics for a wellbore production tubing string comprising the steps of:

passing an expansion member through at least one production tubing string member having an interior flowbore surface and an exterior radial surface to smooth the interior flowbore and physically expand the interior flowbore surface from a first diameter to an enlarged second diameter that is about 1% larger than the first diameter, the exterior radial surface of the at least one production tubing string member not being enlarged by the expansion member;

disposing the production tubing string member into a wellbore; and producing a hydrocarbon production fluid through the production tubing string member.

2. The method of claim 1 further comprising the step of assembling a production tubing string from the production tubing string member.

3. A method of increasing fluid flow characteristics for a wellbore production tubing string comprising the steps of:

passing an expansion member through at least one production tubing string member having an interior flowbore surface and an exterior radial surface to smooth the interior flowbore and physically expand the interior flowbore surface from a first diameter to an enlarged second diameter that is about 1% larger than the first diameter, the exterior radial surface of the at least one production tubing string member not being enlarged by the expansion member;

assembling a production tubing string from the production tubing string member;

disposing the production tubing string into a wellbore; and producing a hydrocarbon production fluid through the production tubing string.

4. A method of increasing fluid flow characteristics for a wellbore production tubing string comprising the steps of:

passing an expansion member through a production tubing string member having an interior flowbore surface and an exterior radial surface to smooth the interior flowbore surface wherein the expansion member expands the interior flowbore surface from a first diameter to an enlarged second diameter that is about 1% larger than the first diameter, the exterior radial surface of the production tubing string member not being enlarged by the expansion member; and disposing the production tubing string member into a wellbore.

5. The method of claim 4 further comprising the step of assembling the production tubing string member into a production tubing string prior to disposing the production tubing string member into a wellbore.

6. The method of claim 5 further comprising the step of producing a hydrocarbon production fluid through the production tubing string.

* * * * *